United States Patent [19]

Morishita et al.

[11] Patent Number: 4,651,177

[45] Date of Patent: Mar. 17, 1987

[54] THERMAL TRANSFER RECORDING MATERIAL

[75] Inventors: Sadao Morishita, Ibaraki; Toshihiko Matsushita, Tokyo; Mikiya Sekine, Warabi, all of Japan

[73] Assignee: Mitsubishi Paper Mills, Ltd., Tokyo, Japan

[21] Appl. No.: 738,474

[22] Filed: May 28, 1985

[30] Foreign Application Priority Data

| | | | |
|---|---|---|---|
| May 31, 1984 | [JP] | Japan | 59-111866 |
| Jun. 22, 1984 | [JP] | Japan | 59-129606 |
| Jul. 3, 1984 | [JP] | Japan | 59-138485 |

[51] Int. Cl.[4] ..... B41M 5/00

[52] U.S. Cl. ..... 346/227; 346/1.1; 427/256; 425/484; 425/488.4; 425/913; 425/914

[58] Field of Search ..... 346/227, 1.1; 428/488.1, 488.4, 913, 914, 484; 427/256

[56] References Cited

FOREIGN PATENT DOCUMENTS

| | | | |
|---|---|---|---|
| 1421069 | 10/1968 | Fed. Rep. of Germany | 428/914 |
| 0137191 | 8/1982 | Japan | 346/227 |
| 0185193 | 11/1982 | Japan | 428/914 |
| 0042995 | 3/1984 | Japan | 346/227 |

*Primary Examiner*—Bruce H. Hess

*Attorney, Agent, or Firm*—Cushman, Darby & Cushman

[57] ABSTRACT

A thermal transfer recording material comprising a combination of a donor sheet having a heat meltable ink layer on a support and an image receiving sheet which are superposed so that the heat meltable ink layer on the donor sheet contacts with the image receiving sheet, the thermal transfer being carried out by a thermal head, wherein either said donor sheet or said image receiving sheet or both sheets are characterized by being such that 1. the heat meltable ink layer of the donor sheet principally comprises a colored dye or pigment, a binder and a wax which are coated on the support as an aqueous solution and/or an aqueous emulsion;
2. the image receiving sheet has, coated thereon, a heat meltable substance having a melting point higher than that of said heat meltable ink layer.

10 Claims, No Drawings

THERMAL TRANSFER RECORDING MATERIAL

This invention relates to a thermal transfer recording material capable of developing gradation for use in the thermal transfer recording system of the melt transfer type employing a thermal head. More particularly, it relates to said recording material characterized by the thermal transfer sheet and/or the image receiving sheet.

In the conventionally known thermal transfer recording systems, there have heretofore been known a thermal sublimation transfer process, in which an ink layer containing a heat sublimable dye is formed on a support and the dye is transferred to an image receiving sheet by sublimation under heating, and a thermal melt transfer process, in which a meltable ink layer containing a colored dye or pigment is formed on a support (hereinafter such a sheet is referred to as thermal transfer sheet or donor sheet) and the dye or pigment is melt transferred by heating to an image receiving sheet. The thermal sublimation transfer process, in which a dye is transferred in gas form to record an image of excellent gradation, is generally believed to be promising as a full color recording process and several attempts have been made to improve the dyeability of image receiving sheet [Japanese Patent Application "Kokai" (Laid-open) Nos. 91,296/82, 107,885/82, 137,191/82, 59,495/84, and 64,393/84].

However, because of a high sublimation temperature of dyes, the thermal sublimation transfer process has disadvantages of a longer heating time and a lower recording speed. Although it is possible to use a dye of lower sublimation temperature, the recorded image is inferior in preservability owing to resublimation of the dye and in light fastness originated in most of dyes. For these reasons, attempts have recently been made to improve gradation of the image reproduced by the melt transfer process which is higher in recording speed and preservability of the recorded image.

Japanese Patent Application "Kokai" (Laid-open) No. 56,295/82, as an example, discloses a recording material comprising a support and, provided thereon, a heat meltable ink layer (A) which is overlaid with another layer (B) spotted, in the form of noncontiguous halftone dots, with an ink melting at a temperature lower than the melting point of layer (A) so that when heated the transferred quantity of the ink varies locally to develop gradation.

In Japanese Patent Application "Kokai" (Laid-open) No. 64,391/84, there is described a recording material comprising a support and, provided thereon, a layer containing an image forming substance capable of producing an image by heating, which layer is overlaid with an image receiving layer capable of receiving said image forming substance which, upon heating, is transferred to a medium which receives the transferred image, thereby to control the amount of the image-forming substance thermally transferred to the image-receiving sheet.

Both of the above recording materials described in Japanese Patent Application "Kokai" (Laid-open) Nos. 56,295/82 and 64,391/84 are made to develop gradation by contrived design of the ink layer coated on a support, which requires double coating of the donor sheet, adversely affecting the production cost.

The conventional donor sheet comprises a support coated theron a heat meltable ink comprising an organic dye or pigment, a binder, a wax and other additives and coating of the ink on a support is carried out by gravure coating method or flexographic coating method. Since the wax of said ink component is coated in heat-melted state, the coated layer on the support is sufficiently densely packed. Therefore, the heat given to the donor sheet by a thermal head is readily transferred from the support to the coated layer and thus the ink of the areas which contact with the thermal head is nearly completely melted. Specifically, when the donor sheet and an ordinary paper or a coated paper are superposed so that the ink layer contacts with the paper and thermal transfer impression is made from the donor sheet side by a heat sensitive facsimile or printer, the ink of the heat-applied area is transferred and that of the heat-unapplied area is not transferred, that is, on-off binary tone recording is obtained.

Even if instead of the ordinary printers as referred to above a printer which can produce transfer density gradation, e.g., of 16 gradation stages is employed, use of the conventional donor sheet cannot provide density gradation and can afford only a very hard image of on-off binary tone.

Therefore, attempts are being made in the art to obtain images of high gradation by combination of a method of providing density gradation by carrying out superposed impressions using a number of donor sheets different in density of the heat meltable ink a number of times depending on density and an area gradation method according to which density difference is produced by controlling the number of dots in a matrix to be impressed. Such a method is complicated and furthermore requires high cost in production of the donor sheet and is low in impression speed.

As for the image receiving sheet, no attempt has been made up to the present for developing gradation, but an ordinary grade paper or a coated printing paper is currently being used as the image receiving material.

An object of this invention is to provide a novel image receiving sheet capable of developing gradation even when use is made of a conventional donor sheet which is difficult to develop gradation.

Another object of this invention is to provide an inexpensive donor sheet which bears a single coated layer and is capable of developing gradation.

A further object of this invention is to provide a thermal transfer recording material, in which the said donor sheet and image receiving sheet are combined and which is capable of developing more improved gradation.

This invention provides a thermal transfer recording material comprising a combination of a thermal transfer sheet (donor sheet) having a heat meltable ink layer on a support and an image receiving sheet which are superposed so that the heat meltable ink layer on the donor sheet contacts with the image receiving sheet, the thermal transfer being carried out by a thermal head, wherein said donor sheet or said image receiving sheet or both sheets are characterized by being such that (1) the heat meltable ink layer of the donor sheet principally comprises a colored dye or pigment, a binder, and a wax which are coated on the support as an aqueous solution and/or an aqueous emulsion, and (2) the image receiving surface of the image receiving sheet is coated with a heat meltable substance having a melting point higher than that of the heat meltable ink layer.

The donor sheet contains in the heat meltable ink layer preferably 0.5 to 25% by weight of a colored dye or pigment, 0.5 to 50% by weight of a binder, and 50 to 99% by weight of a wax and preferably said colored dye or pigments comprise at least yellow, magneta, and cyan in color, which are individually applied on the same support. The coated layer of the image receiving sheet comprises preferably as the heat meltable substance a waxy substance having a melting point of 50° to 200° C.

In the present thermal transfer recording material capable of developing gradation, although either the donor sheet or the image receiving sheet developes gradation, more enhanced gradation is developed by combining both sheets capable of developing gradation. The reasons for the development of gradation by the donor sheet and the image receiving sheet according to this invention are as described below.

The donor sheet of this invention bearing a single coated layer develops gradation. The reason for this seems to be such that since the wax exists in particulate form in the thermal transfer ink layer, the amount of molten wax and, hence, the amount of transfer to the image receiving sheet increases in proportion to the increase of energy supplied from the thermal head, resulting in density gradation. The content of a binder also affects the amount of thermal transfer of ink. With the increase in the amount of binder, the density of the transferred image becomes decreased, though the number of printed copies is increased. With further increase of the amount of binder, the thermal transfer tends to become insignificant. The density gradation depends largely upon the amount of binder as well as upon the amount, type, melting point, and the form of waxes (particulate or continuous phase) in the ink layer.

The waxes suitable for use in the present recording material are those having a melting point in the range of from 50° to 200° C., preferably from 60° to 150° C. If the melting point is below 50° C., the density gradation is difficult to develop, because the sensitivity of ink becomes too high in thermal transfer even though the wax exists in particulate form in the ink layer. Conversely if the melting point of wax is higher than 200° C., the energy requirement of thermal head becomes too high and the amount of thermal transfer becomes too small to be practicable.

The reason for the development of gradation caused by the image receiving sheet according to this invention seems to be as described below.

If the energy supplied from the thermal head is small and the coated layer of the image receiving sheet has a weak adhesive power due to little or no adhesive content, the ink layer transferred to the image receiving sheet will be torn apart into two and there will occur reverse transfer of the ink layer to the donor sheet when the donor sheet and the image receiving sheet are pulled apart. In the case of conventional image receiving sheet, almost all the colored ink is transferred from the donor sheet, whereas in the case of the present recording material, substantially no colored ink will be transferred to the image receiving sheet in the initial stage.

In the next stage, with a little increase in the energy supplied from the thermal head, the mixed melt of the coated layer of the image receiving sheet and the colored ink layer of the donor sheet will be torn apart into two when both sheets are pulled apart, resulting in a little transfer of the colored ink layer from the donor sheet to the image receiving sheet. The amount of transferred ink is increased with the increase in energy supplied from the thermal head until finally all of the colored ink layer on the donor sheet will be transferred to the image receiving sheet and absorbed through the pores in the surface of image receiving sheet, because the colored ink layer of the donor sheet has a melting point lower than that of the coated layer of the image receiving sheet.

It seems that for the reasons described above, the recording material of the present invention develops gradation.

Contrary to the present invention, if the coated layer of the image receiving sheet has a melting point lower than that of the colored ink layer of the donor sheet, the colored ink layer is diluted with the coated layer of the image receiving sheet and transferred to the image receiving sheet without developing gradation.

The donor sheet and the image receiving sheet of this invention may be stored in the superposed form or may be superposed on use.

They are described in detail in the following.

I. Donor sheet.

As nonlimitative examples of waxes used in the present recording material, mention may be made of the following:

Waxes of the vegetable origin: rice wax, Japan wax, candelilla wax, and carnauba wax.

Waxes of the animal origin: lanolin, beeswax, and shellac wax.

Mineral waxes: montan wax.

Synthetic waxes: paraffin wax, microcrystalline wax, oxidized paraffin wax, chlorinated paraffin wax, ricinolic acid amide, lauric acid amide, erucic acid amide, palmitic acid amide, oleic acid amide, 12-hydroxystearic acid amide, distearyl ketone, and ethylenebisstearic acid amide.

Metal soaps: sodium stearate, sodium palmitate, potassium laurate, potassium myristate, calcium stearate, zinc stearate, aluminum stearate, magnesium stearate, lead stearate, and dibasic barium stearate.

Higher fatty acids: palmitic acid and stearic acid.

Higher alcohols: palmityl alcohol, stearyl alcohol, and ceryl alcohol.

Synthetic polyalcohols: polyethylene glycol and polypropylene glycol.

These waxes are used each alone or in mixtures of two or more after adjusting the melting point to the range of from 50° to 200° C. The amount of wax in the ink layer is preferably in the range of from 50 to 99% by weight. If the amount is below 50% by weight, the amount of transferred ink becomes insufficient to produce sufficient image density, whereas if it exceeds 99% by weight, the image density becomes also insufficient for practical use because of dilution of the dye or pigment, though the transferred amount of ink is increased.

Suitable binders include both water soluble and insoluble types. The former type is used in the form of aqueous solution, while the latter type is used as emulsified in an aqueous medium.

As nonlimitative, typical examples of binders, mention may be made of polyvinyl alcohol, methylcellulose, gelatin, hydroxyethylcellulose, carboxymethylcellulose, gum arabic, starch and derivatives thereof, casein, polyvinylpyrrolidone, styrene-butadiene copolymer, vinyl acetate resin, vinyl acetate copolymers, methyl methacrylate resin, styrene-acrylonitrile resin, and ethylene-vinyl acetate copolymer. These may be used alone or in combination of two or more.

The proportion of a binder in the ink layer is generally 0.5 to 50, preferably 5 to 25, % by weight. When the wax used jointly with a binder has a low melting point, a larger proportion of the binder is desirable, while when the wax has a high melting point, a smaller proportion of the binder is sufficient to develop satisfactory gradation. It is undesirable to use a binder in a proportion of 50% or more, because a transferred image of very soft gradation is formed owing to the reduction in amount of transferred wax even when a wax of low melting point is used.

The dyes and pigments used in the present recording material include water-soluble dyes, oil-soluble dyes and pigments, disperse dyes, and solvent-insoluble colored pigments. There is no direct relation between the dyes or pigments and the gradation. The water-soluble dyes are used in the form of aqueous solution, while the oil-soluble dyes or pigments and solvent-insoluble pigments are used as emulsified in an aqueous medium. The emulsion of fine particle size of about 1$\mu$ or below is preferred to reduce the coarseness of particles of the transferred image. A dye of the sublimation type can be used without interfering with the object of this invention so long as it is used as a coloring material, though the function of sublimation of a dye cannot be exhibited in this invention.

The proportion of a dye or pigment in the heat meltable ink layer is generally 0.5 to 25, preferably 1 to 15, % by weight. If the proportion of dye or pigment is less than 0.5% by weight, the transferred image becomes low in density and soft in gradation, whereas if the proportion exceeds 25% by weight, the density of transferred image becomes unnecessarily high, resulting in an economic waste, and the contrast between the image and the background becomes strong enough to develop undesirably hard gradation.

Nonlimitative, typical examples of dyes and pigments used in the present recording material are shown below. Such dyes and pigments can be used also in mixtures.

Water-soluble dyes include nitroso dyes, azo (mono-, bis-, tris-, and tetrakis-azo) dyes, stilbeneazo dyes, ketoimine (diphenylmethane) dyes, triphenylmethane dyes, xanthene dyes, acridine dyes, quinoline dyes, methine dyes, polymethine dyes, thiazole dyes, indamine dyes, azine dyes, thiazine dyes, oxyketone dyes, anthraquinone dyes, and phthalocyanine dyes. As examples of particular dyes, mention may be made of Mordant Green 4 (C.I. 10005 a nitroso dye; hereinafter the C.I. number is given in parentheses), Direct Red 28 (22120, an azo dye), Direct Orange 71 (40205, a stilbeneazo dye), Basic Yellow 2 (41000, a ketoimine dye), Basic Blue 1 (42025, a triphenylmethane dye), Acid Red 52 (45100, a xanthene dye), Basic Orange 23 (46075, an acridine dye), Acid Yellow 2 (47010, a quinoline dye), Direct Yellow 59 (49000, a methine dye), Acid Blue 59 (50315, an azine dye), Mordant Blue 10 (51030, an oxazine dye), Basic Blue 9 (52015, a thiazine dye), Acid Blue 45 (63010, an anthraquinone dye), and Direct Blue 86 (74180, a phthalocyanine dye).

Oil-soluble dyes include azo dyes, azo metal complex dyes, anthraquinone dyes, and phthalocyanine dyes. As examples of particular dyes, mention may be made of Solvent Yellow 2 (11020, an azo dye), Solvent Orange 1 (11920, an azo dye), Solvent Red 24 (26105, an azo dye), and Solvent Brown 3 (11360, an azo dye), Solvent Yellow 19 (13900A, an azo metal complex dye), Solvent Orange 5 (18745A, an azo metal complex dye), Solvent Red 8 (12715, an azo metal complex dye), Solvent Brown 37 (an azo metal complex dye), Solvent Black 123 (12195, an azo metal complex dye), Solvent Violet 13 (60725, an anthraquinone dye), Solvent Blue 11 (61525, an anthraquinone dye), Solvent Green 3 (61565, an anthraquinone dye), and Solvent Blue 25 (74350, a phthalocyanine dye).

Disperse dyes include aminoazo or aminoanthraquinone dyes and nitroarylamine dyes. As examples of individual disperse dyes, mention may be made of Disperse Yellow 3 (11855), Disperse Orange 3 (11005), Disperse Red (11110), Disperse Violet 24 (11200), and Disperse Blue 44 among aminoazo dyes; Disperse Orange 11 (60700), Disperse Red 4 (60755), Disperse Violet 1 (61100), and Disperse Blue 3 (61505) among aminoanthraquinone dyes; Disperse Yellow 1 (10345) and Disperse Yellow 42 (10338) among nitroarylamine dyes.

Colored pigments include azo (mono-, bis-, and condensed-azo) pigments, dyed lake pigments (acid dye-, basic dye-, and mordant dye-like pigments), nitro pigments, nitroso pigments, phthalocyanine pigments, and high-grade pigments (vat dye pigments, metal complex pigments, perylene pigments, Isoindolinon pigments, and quinacridone pigments). As examples of colored pigments, mention may be made of Hansa Yellow G (11680), Hansa Yellow R (12710), Pyrazolone Red B (21120), Permanent Red R (12085), Lake Red C (15585), Brilliant Carmine 6B (15850), and Permanent Carmine FB (12490) among monoazo pigments; Benzidine Yellow G (21090), Benzidine Yellow GR (21100), and Permanent Yellow NCR (20040) among bisazo pigments; Cromophtal Yellow and Cromophtal Red among condensed azo pigmenets; Quinoline Yellow Lake (47005), Eosine Lake (45380), and Alkali Blue Lake (42750A, 42770A) among acid dye lake pigments; Rhodamine B Lake (45170), Methyl Violet Lake (42535), Victoria Blue Lake (44045), and Malachite Green Lake (42000) among basic dye lake pigments; Alizarine Lake (58000) among mordant dye lake pigments; Naphthol Yellow S (10316) among nitro pigments; Pigment Green B (10006) and Naphthol Green B (10020) among nitroso pigments; Metalfree Phthalocyanine Blue (74100), Phthalocyanine Blue (74160), and Phthalocyanine Green (74260) among phthalocyanine pigments; Anthrapyrimidine Yellow (68420), Indanthrene Brilliant Orange GK (59305), Indanthrene Blue RS (69800), and Thioindigo Red B (73300) among vat dye pigments; Nickel Azo Yellow (12775) among metal complex pigments; Perylene Red (71140) and Perylene Scarlet (71137) among perylene pigments; Isoindolinon Yellow among Isoindolinon pigments; Quinacridone Red Y (46500) and Quinacridone Magenta (73915) among quinacridone pigments; and carbon black (77265) among black pigments.

The ink layer according to this invention comprises as major constituents those colored dyes or pigments, binders, and waxes which are described above. Before applying the coating composition to a support, other additives such as, for example, surface active agents and dispersants can be added to the coating composition.

The supports used in the donor sheet of this invention include thin paper such as capacitor tissue paper, typewriter manifold, or tracing paper; synthetic paper, cellophane, and synthetic resin films such as polyester film, polyimide film, polyethylene film, polycarbonate film, polystyrene film, and Teflon film. These support materials are used without any treatment or after heat resisting treatment so as not to stick to the thermal head.

The coating is performed by means of known coaters such as air knife coater, roll coater, blade coater, and bar coater. Known printing presses used in flexography and photogravure can also be used. To produce a full color image, inks of at least three colors of yellow, magenta, and cyan are each partially and successively printed in linewise, areawise, and dotwise onto the same support. In printing such partial printing by a printer, if the drying of each partially applied ink coating is not sufficiently rapid, a water-soluble rapid-drying solvent such as methanol or ethanol can be added to the coating composition, so long as an aqueous medium is used in the coating composition according to this invention.

II. Image receiving sheet.

The coating component for the image receiving sheet is applied onto ordinary paper, coated printing paper, sunthetic paper, or synthetic resin film. It is heat meltable and has a film-forming property and preferably a low adhesive strength. Such heat meltable substances include vegetable waxes such as rice wax, Japan wax, candelilla wax, and carnauba wax; animal waxes such as lanolin, beeswax, and shellac wax; mineral waxes such as montan wax; synthetic waxes such as paraffin wax, microcrystalline wax, oxidized paraffin wax, chlorinated paraffin wax, ricinolic acid amide, lauric acid amide, erucic acid amide, palmitic acid amide, oleic acid amide, 12-hydroxystearic acid amide, distearyl ketone, and ethylenebisstearic acid amide; metal soaps such as sodium stearate, sodium palmitate, potassium laurate, potassium myristate, calcium stearate, zinc stearate, aluminum stearate, magnesium stearate, lead stearate, and dibasic barium stearate; higher fatty acid such as palmitic acid and stearic acid; higher alcohols such as palmityl alcohol, stearyl alcohol, and ceryl alcohol; synthetic polyalcohols such as polyethylene glycol and polypropylene glycol; and various surface active agents. These waxy substances are used each alone or as a mixture made by melting together two or more waxes, provided the melting point is higher than that of the ink layer of the donor sheet. Especially preferred are waxy substances having a melting point in the range of from 50° to 200° C. If the melting point is lower than 50° C., the image receiving sheet tends to become sticky during storage, causing blocking, whereas if it is above 200° C. the coating layer of the image receiving sheet becomes difficulty meltable by the heat supplied from the thermal head, resulting in insufficient gradation of the transferred image.

According to this invention, it is essential to coat ordinary paper, coated printing paper, synthetic paper, or synthetic resin film with the waxy substances either each alone or in mixtures made by melting together two or more waxes. If a known adhesive is added, its amount should be controlled so as not to increase excessively the adhesion strength of the coated layer. The addition of a white pigment is unfavorable for the gradation of the transferred image.

For reference, as conventional image receiving sheets there are used so-called ordinary papers such as PPC paper and wood-free paper (in some cases ordinary paper is coated with starch, polyvinyl alcohol, or a size by means of a size press, but is still called ordinary paper and not coated paper) and coated printing paper (base paper such as wood-free paper is coated with a coating composition comprising as major constituents a white pigment and an adhesive to improve brightness of the printed color). When thermal transfer impression is made from a conventional donor sheet (the melting point of the ink layer is generally 50° to 90° C.), the transferred image will not show density gradation, because the donor sheet carries a record in on-off binary tone.

In making the image receiving sheet according to this invention, the coating composition is applied to a support by means of known coaters such as air knife coater, roll coater, blade coater, and bar coater. Known printing presses used in flexography and photogravure can also be used. It is further possible to use a size press of papermaking machine.

The image receiving sheet of this invention develops gradation even from a conventional donor sheet which is difficult to develop gradation. Therefore, phototelegraphy is possible by means of a commercial halftone facsimile unit. It is also possible to reproduce a color image with gradation, besides a black and white image, by using donor sheets in yellow, magenta, cyan, and black color.

As compared with a conventional donor sheet prepared by complicated coating procedure, the donor sheet of this invention prepared by single coating of an aqueous coating composition is lower in production cost and superior in gradation of the reproduced image.

As compared with the conventional thermal transfer recording material capable of developing gradation which is prepared by complicated coating procedure, the thermal transfer recording material of the present invention comprising a donor sheet and an image receiving sheet which are both prepared by a single coating procedure using an aqueous coating composition is lower in production cost and superior in gradation of the reproduced image.

As described in the foregoing, the present invention is of an important industrial significance.

As is clear from the explanations hereinbefore and Examples given hereinafter, as long as the donor sheet satisfies the requirements of this invention, images having gradation aimed at by this invention can be obtained even if a conventional image receiving sheet, e.g., ordinary paper is used in combination with said donor sheet (see Example 4 hereinafter). On the other hand, as long as the image receiving sheet satisfies the requirement of this invention, images having gradation aimed at by this invention can be obtained even if a conventional donor sheet, e.g., having an ink layer formed by non-aqueous coating such as hot melt coating is used with said image receiving sheet (see Example 1). However, further superior result can be obtained when both the donor sheet and the image receiving sheet satisfy the requirements of this invention (see Example 9 hereinafter).

The invention is illustrated in detail below with reference to Examples.

EXAMPLE 1

Image receiving sheets were obtained by coating a sheet of ordinary paper (thermal transfer receiving paper TTR-T, trade name, of Mitsubishi Paper Mills, Ltd.), used as base sheet, with aqueous emulsions of waxes of different melting points, the emulsions containing no adhesive, at a coverage of 5 g/m$^2$ on dry basis. The types and melting points of the waxes were as shown in Tables 1 to 3.

Donor sheets were obtained by coating a capacitor tissue, 10$\mu$ in thickness, with hot melt of coating compositions of the following formulas at a coverage of 3.5 g/m$^2$ on dry basis. The melting points of coating layers of donor sheets 1, 2 and 3 were 50° C., 65° C. and 82° C., respectively.

| | Parts |
|---|---|
| Donor sheet 1 (melting point 50° C.) | |
| Carbon black | 9 |
| 115° F. Paraffin wax | 80 |
| Ethylene-vinyl acetate resin | 5 |
| Petroleum resin (ARUKON M of Arakawa Kagaku Co.) | 6 |
| Donor sheet 2 (melting point 65° C.) | |
| Carbon black | 9 |
| Paraffin SP-0145 (Nippon Seiro Co.) | 45 |
| No. 1 Carnauba wax | 34 |
| Ethylene-vinyl acetate resin | 6 |
| Petroleum resin (ARUKON M of Arakawa Kagaku Co.) | 6 |
| Donor sheet (melting point 82° C.) | |
| Carbon black | 9 |
| No. 1 Carnauba wax | 66 |
| Synthetic carnauba wax | 13 |
| Ethylene-vinyl acetate resin | 6 |
| Petroleum resin (ARUKON M of Arakawa Kagaku Co.) | 6 |

The donor sheet and the image receiving sheet were brought together so that the coated sides of both sheets may come into contact with each other. Thermal impression was carried out by applying heat (16.0 V pulse) onto the back side of the donor sheet by means of a facsimile test apparatus (Matsushita Denshi Buhin Co.) while varying the pulse width from 1.0 to 3.0 milliseconds at steps of 0.2 millisecond. The density of the transferred image was measured with an optical densitometer (Type RD 514, Macbeth).

For comparison, similar test was performed on an ordinary paper used as the image receiving sheet.

The test results were as summarized in Tables 1 to 3. As is apparent from the tables; with reference to all of donor sheets 1, 2 and 3, when ordinary paper was used as the image receiving sheet or when the coating layer of the image receiving sheet had a melting point lower than that of the ink layer of the donor sheet, with the increase in pulse width the transferred image showed rapid increase in optical density without exhibiting gradation. On the contrary, when the melting point of an image receiving sheet is higher than that of the ink layer of the donor sheet, with the increase in pulse width the density of the transferred image showed a slow increase, exhibiting sufficient gradation.

TABLE 1

| Image receiving sheet | | (Donor sheet 1) Pulse width (millisecond) | | | | | | | | | | |
|---|---|---|---|---|---|---|---|---|---|---|---|---|
| Wax | m.p. (°C.) | 1.0 | 1.2 | 1.4 | 1.6 | 1.8 | 2.0 | 2.2 | 2.4 | 2.6 | 2.8 | 3.0 |
| Paraffin wax | 60 | 0.28 | 0.46 | 0.66 | 0.90 | 1.12 | 1.25 | 1.30 | 1.30 | 1.27 | 1.25 | 1.22 |
| Polyethylene glycol #600 | 62 | 0.23 | 0.45 | 0.60 | 0.75 | 0.97 | 1.18 | 1.29 | 1.30 | 1.29 | 1.28 | 1.27 |
| Synthetic carnauba wax | 82 | 0.15 | 0.30 | 0.45 | 0.56 | 0.71 | 0.97 | 1.18 | 1.27 | 1.28 | 1.26 | 1.25 |
| Stearic acid amide | 98 | 0.09 | 0.26 | 0.34 | 0.48 | 0.68 | 0.87 | 1.03 | 1.17 | 1.25 | 1.20 | 1.21 |
| Paraffin wax | 47 | 0.78 | 1.45 | 1.47 | 1.46 | 1.40 | 1.38 | 1.34 | 1.30 | 1.28 | 1.26 | 1.24 |
| Uncoated base sheet | — | 0.68 | 1.37 | 1.40 | 1.37 | 1.37 | 1.34 | 1.31 | 1.27 | 1.22 | 1.22 | 1.20 |

TABLE 2

| Image receiving sheet | | (Donor sheet 2) Pulse width (millisecond) | | | | | | | | | | |
|---|---|---|---|---|---|---|---|---|---|---|---|---|
| Wax | m.p. (°C.) | 1.0 | 1.2 | 1.4 | 1.6 | 1.8 | 2.0 | 2.2 | 2.4 | 2.6 | 2.8 | 3.0 |
| Paraffin wax | 67 | 0.21 | 0.44 | 0.66 | 0.93 | 1.18 | 1.30 | 1.34 | 1.37 | 1.36 | 1.35 | 1.32 |
| Synthetic carnauba wax | 82 | 0.20 | 0.34 | 0.49 | 0.63 | 0.80 | 1.04 | 1.22 | 1.30 | 1.35 | 1.34 | 1.32 |
| Microcrystalline wax | 96 | 0.17 | 0.30 | 0.42 | 0.51 | 0.63 | 0.78 | 1.00 | 1.25 | 1.35 | 1.34 | 1.33 |
| Zinc stearate | 120 | 0.15 | 0.29 | 0.39 | 0.45 | 0.52 | 0.64 | 0.80 | 1.01 | 1.30 | 1.38 | 1.36 |
| Ethylenebisstearic acid amide | 138 | 0.08 | 0.15 | 0.21 | 0.29 | 0.37 | 0.47 | 0.62 | 0.85 | 1.20 | 1.34 | 1.33 |
| Paraffin wax | 60 | 0.60 | 1.50 | 1.60 | 1.63 | 1.64 | 1.63 | 1.60 | 1.58 | 1.56 | 1.55 | 1.52 |
| Polyethylene glycol #600 | 62 | 0.63 | 1.50 | 1.64 | 1.65 | 1.63 | 1.62 | 1.60 | 1.55 | 1.53 | 151 | 1.49 |
| Uncoated base sheet | — | 0.32 | 1.45 | 1.58 | 1.57 | 1.55 | 1.54 | 1.53 | 1.49 | 1.50 | 1.48 | 1.47 |

TABLE 3

| Image receiving sheet | | (Donor sheet 3) Pulse width (millisecond) | | | | | | | | | | |
|---|---|---|---|---|---|---|---|---|---|---|---|---|
| Wax | m.p. (°C.) | 1.0 | 1.2 | 1.4 | 1.6 | 1.8 | 2.0 | 2.2 | 2.4 | 2.6 | 2.8 | 3.0 |
| Microcrystalline wax | 96 | 0.18 | 0.28 | 0.41 | 0.53 | 0.67 | 0.85 | 1.07 | 1.29 | 1.37 | 1.36 | 1.34 |
| Stearic acid amide | 98 | 0.12 | 0.20 | 0.30 | 0.44 | 0.59 | 0.76 | 0.99 | 1.21 | 1.34 | 1.35 | 1.33 |
| Methylol amide | 107 | 0.10 | 0.14 | 0.20 | 0.28 | 0.37 | 0.51 | 0.73 | 0.95 | 1.20 | 1.36 | 1.40 |
| Zinc stearate | 120 | 0.04 | 0.10 | 0.16 | 0.21 | 0.29 | 0.42 | 0.57 | 0.75 | 1.00 | 1.24 | 1.36 |
| Ethylenebisstearic acid amide | 138 | 0.03 | 0.07 | 0.12 | 0.15 | 0.18 | 0.26 | 0.40 | 0.60 | 0.88 | 1.15 | 1.35 |
| Paraffin wax | 67 | 0.20 | 0.97 | 1.58 | 1.80 | 1.84 | 1.79 | 1.76 | 1.75 | 1.70 | 1.66 | 1.64 |
| Stearic acid | 71 | 0.07 | 0.89 | 1.50 | 1.70 | 1.81 | 1.82 | 1.81 | 1.76 | 1.74 | 1.72 | 1.70 |
| Uncoated base paper | — | 0.05 | 0.63 | 1.37 | 1.62 | 1.75 | 1.77 | 1.74 | 1.72 | 1.69 | 1.70 | 1.64 |

EXAMPLE 2

Similar tests to those of Example 1 were carried out using coated paper (deluxe art paper of Mitsubishi Paper Mills, Ltd.) in place of the ordinary paper. The results showed similar tendencies to those of Example 1.

EXAMPLE 3

Among donor sheets and image receiving sheets tested in Example 2, there was selected a combination of donor sheet 3 (melting point 82° C.) and the image receiving sheet bearing a coated layer of methylol amide (melting point 107° C.). Using the combination, picture transmission and reception were conducted by means of a commercial phototelegraphic apparatus of the thermosensitive type (Photo-fax of Oki Electric Industry Co.). It was found that reproduction of an image with good gradation was possible. For comparison, test was repeated on a combination of donor sheet 3 and an image receiving sheet (deluxe art paper) bearing no wax coating. There was obtained a reproduced image of high contrast with unsatisfactory middle tone.

EXAMPLE 4

Several donor sheets for use in the present thermal transfer recording material capable of developing gradation were prepared by coating, by means of Mayer bar, a capacitor tissue, 10μ in thickness, with 4 g/m$^2$ (dry basis) of an aqueous coating composition of a heat meltable ink comprising Crystal Violet (CV), a water-soluble dye, ethylene-vinyl acetate emulsion (OM-4000 of Kuraray Co.), a binder, and methylol amide (melting point 107° C.), a wax, in a compounding ratio as shown in Table 4, said ink composition being applied in the form of an aqueous emulsion.

The coated side of the above donor sheet was brought into contact with a sheet of ordinary paper (TTR-T, a thermal transfer image receiving paper of Mitsubishi Paper Mills, Ltd.). Thermal impression was performed by applying thermal printing to the back side of the donor sheet by means of a facsimile test apparatus (Matsushita Denshi Buhin Co.) while varying the 16.0 V pulse width from 1.0 to 3.0 milliseconds at steps of 0.2 millisecond. The density of the transferred image was measured with an optical densitometer (Type RD 514, Macbeth).

For comparison, donor sheets were similarly prepared by using no binder or a binder in an amount not specified in the present invention.

As is apparent from the test results shown in Table 4, when the ink layer contained 1, 5, 10, 25, or 50% by weight of a binder, the transferred image showed gradual increase in optical density with the increase in pulse width, whereas when the ink layer contained no binder, the transferred image showed a rapid increase in density with the increase in pulse width. When the ink layer contained 55 or 75% by weight of a binder, the optical density of the transferred image increased very slowly.

It is apparent from the above results that a donor sheet carrying an ink layer according to the present invention can produce a transferred image with desirable gradation.

TABLE 4

| | | No. 1 | No. 2 | No. 3 | No. 4 | No. 5 | No. 6 | No. 7 | No. 8 |
|---|---|---|---|---|---|---|---|---|---|
| Compounding ratio | Crystal Violet | 2 | 2 | 2 | 2 | 2 | 2 | 2 | 2 |
| | Ethylene-vinyl acetate | 1 | 5 | 10 | 25 | 50 | 55 | 75 | 0 |
| | Methylol amide | 97 | 93 | 88 | 73 | 48 | 43 | 23 | 98 |
| Pulse width (millisecond) | 1.0 | 0.03 | 0.03 | 0.03 | 0.03 | 0.03 | 0.02 | 0.02 | 0.03 |
| | 1.2 | 0.04 | 0.04 | 0.04 | 0.04 | 0.04 | 0.02 | 0.02 | 0.06 |
| | 1.4 | 0.05 | 0.05 | 0.05 | 0.05 | 0.05 | 0.03 | 0.03 | 0.10 |
| | 1.6 | 0.08 | 0.07 | 0.06 | 0.06 | 0.06 | 0.04 | 0.04 | 0.25 |
| | 1.8 | 0.22 | 0.18 | 0.15 | 0.12 | 0.10 | 0.07 | 0.06 | 0.65 |
| | 2.0 | 0.42 | 0.37 | 0.32 | 0.27 | 0.18 | 0.12 | 0.10 | 0.96 |
| | 2.2 | 0.71 | 0.67 | 0.60 | 0.55 | 0.38 | 0.15 | 0.13 | 1.02 |
| | 2.4 | 0.93 | 0.86 | 0.81 | 0.76 | 0.63 | 0.22 | 0.17 | 1.02 |
| | 2.6 | 0.97 | 0.93 | 0.88 | 0.83 | 0.72 | 0.24 | 0.20 | 1.01 |
| | 2.8 | 0.99 | 0.95 | 0.91 | 0.87 | 0.74 | 0.26 | 0.22 | 1.00 |
| | 3.0 | 1.00 | 0.97 | 0.92 | 0.88 | 0.76 | 0.28 | 0.23 | 1.00 |

EXAMPLE 5

The procedure of Example 4 was repeated, except that a styrene-butadiene latex was used in place of the ethylene-vinyl acetate emulsion used as the binder. The optical densities of transferred images were as shown in Table 5. The results were similar to those obtained in Example 4.

TABLE 5

| | | No. 1 | No. 2 | No. 3 | No. 4 | No. 5 | No. 6 | No. 7 | No. 8 |
|---|---|---|---|---|---|---|---|---|---|
| Compounding ratio | Crystal Violet | 2 | 2 | 2 | 2 | 2 | 2 | 2 | 2 |
| | Styrene-butadiene latex | 1 | 5 | 10 | 25 | 50 | 55 | 75 | 0 |
| | Methylol amide | 97 | 93 | 88 | 73 | 48 | 43 | 23 | 98 |
| Pulse width (millisecond) | 1.0 | 0.03 | 0.03 | 0.03 | 0.03 | 0.03 | 0.02 | 0.02 | 0.03 |
| | 1.2 | 0.04 | 0.03 | 0.03 | 0.03 | 0.03 | 0.02 | 0.02 | 0.06 |
| | 1.4 | 0.05 | 0.04 | 0.04 | 0.04 | 0.04 | 0.03 | 0.03 | 0.10 |
| | 1.6 | 0.10 | 0.08 | 0.07 | 0.06 | 0.05 | 0.05 | 0.04 | 0.25 |
| | 1.8 | 0.23 | 0.16 | 0.15 | 0.14 | 0.11 | 0.07 | 0.05 | 0.65 |
| | 2.0 | 0.48 | 0.35 | 0.32 | 0.30 | 0.20 | 0.10 | 0.06 | 0.96 |
| | 2.2 | 0.72 | 0.57 | 0.53 | 0.49 | 0.30 | 0.14 | 0.08 | 1.02 |
| | 2.4 | 0.83 | 0.75 | 0.71 | 0.67 | 0.38 | 0.17 | 0.09 | 1.02 |
| | 2.6 | 0.86 | 0.79 | 0.75 | 0.71 | 0.43 | 0.19 | 0.11 | 1.01 |
| | 2.8 | 0.88 | 0.81 | 0.76 | 0.73 | 0.47 | 0.22 | 0.13 | 1.00 |
| | 3.0 | 0.90 | 0.83 | 0.79 | 0.75 | 0.49 | 0.23 | 0.13 | 1.00 |

EXAMPLE 6

The procedure of Example 4 was repeated, except that polyvinyl alcohol and microcrystalline wax having a melting point of 84° C. were used as the binder and wax, respectively, used in Example 4. The optical densities of the transferred images were as shown in Table 6. The results showed similar tendencies to those observed in Example 4.

TABLE 6

| | | No. 1 | No. 2 | No. 3 | No. 4 | No. 5 | No. 6 | No. 7 | No. 8 |
|---|---|---|---|---|---|---|---|---|---|
| Compound- | Crystal Violet | 2 | 2 | 2 | 2 | 2 | 2 | 2 | 2 |

TABLE 6-continued

| | | No. 1 | No. 2 | No. 3 | No. 4 | No. 5 | No. 6 | No. 7 | No. 8 |
|---|---|---|---|---|---|---|---|---|---|
| ing | Polyvinyl alcohol | 1 | 5 | 15 | 25 | 50 | 55 | 75 | 0 |
| ratio | Microcrystalline wax | 97 | 93 | 83 | 73 | 48 | 43 | 23 | 98 |
| Pulse | 1.0 | 0.35 | 0.30 | 0.15 | 0.12 | 0.07 | 0.05 | 0.04 | 0.70 |
| width | 1.2 | 0.55 | 0.50 | 0.33 | 0.19 | 0.13 | 0.05 | 0.05 | 0.82 |
| (milli- | 1.4 | 0.66 | 0.62 | 0.50 | 0.25 | 0.17 | 0.06 | 0.05 | 0.88 |
| second) | 1.6 | 0.74 | 0.70 | 0.57 | 0.29 | 0.20 | 0.06 | 0.05 | 0.89 |
| | 1.8 | 0.78 | 0.75 | 0.60 | 0.32 | 0.23 | 0.07 | 0.06 | 0.89 |
| | 2.0 | 0.82 | 0.78 | 0.63 | 0.35 | 0.26 | 0.07 | 0.07 | 0.88 |
| | 2.2 | 0.83 | 0.81 | 0.67 | 0.37 | 0.28 | 0.08 | 0.08 | 0.88 |
| | 2.4 | 0.84 | 0.82 | 0.68 | 0.40 | 0.29 | 0.08 | 0.08 | 0.87 |
| | 2.6 | 0.85 | 0.82 | 0.69 | 0.42 | 0.32 | 0.09 | 0.09 | 0.87 |
| | 2.8 | 0.85 | 0.82 | 0.70 | 0.44 | 0.34 | 0.09 | 0.09 | 0.86 |
| | 3.0 | 0.85 | 0.83 | 0.70 | 0.46 | 0.36 | 1.00 | 0.09 | 0.86 |

EXAMPLE 7

The procedure of Example 4 was repeated, except that polyvinyl alcohol and paraffin wax of a melting point of 60° C. were used as the binder and wax, respectively, used in Example 4. The optical densities of the transferred images were as shown in Table 7. The results obtained were similar to those obtained in Example 4.

TABLE 7

| | | No. 1 | No. 2 | No. 3 | No. 4 | No. 5 | No. 6 | No. 7 | No. 8 |
|---|---|---|---|---|---|---|---|---|---|
| Compound- | Crystal Violet | 2 | 2 | 2 | 2 | 2 | 2 | 2 | 2 |
| ing | Polyvinyl alcohol | 1 | 5 | 15 | 25 | 50 | 55 | 75 | 0 |
| ratio | Paraffin wax | 97 | 93 | 83 | 73 | 48 | 43 | 23 | 98 |
| Pulse | 1.0 | 0.64 | 0.51 | 0.31 | 0.15 | 0.06 | 0.04 | 0.03 | 0.73 |
| width | 1.2 | 0.78 | 0.69 | 0.49 | 0.33 | 0.18 | 0.08 | 0.06 | 0.93 |
| (milli- | 1.4 | 0.86 | 0.80 | 0.64 | 0.49 | 0.29 | 0.11 | 0.08 | 0.98 |
| second) | 1.6 | 0.89 | 0.86 | 0.74 | 0.60 | 0.40 | 0.14 | 0.09 | 0.99 |
| | 1.8 | 0.90 | 0.89 | 0.80 | 0.68 | 0.47 | 0.15 | 0.09 | 1.00 |
| | 2.0 | 0.91 | 0.90 | 0.83 | 0.73 | 0.52 | 0.16 | 0.11 | 0.98 |
| | 2.2 | 0.92 | 0.91 | 0.84 | 0.77 | 0.55 | 0.18 | 0.12 | 0.97 |
| | 2.4 | 0.92 | 0.91 | 0.85 | 0.78 | 0.57 | 0.19 | 0.13 | 0.97 |
| | 2.6 | 0.92 | 0.91 | 0.86 | 0.78 | 0.60 | 0.20 | 0.14 | 0.96 |
| | 2.8 | 0.93 | 0.90 | 0.86 | 0.79 | 0.61 | 0.21 | 0.15 | 0.96 |
| | 3.0 | 0.93 | 0.90 | 0.87 | 0.79 | 0.62 | 0.21 | 0.15 | 0.95 |

EXAMPLE 8

In the present Example, Crystal Violet, a water-soluble dye used in Example 4, was replaced by a water-insoluble cyan pigment, Phthalocyanine Blue (C.I. 74160). An aqueous dispersion, about 1 μm in particle size, was prepared by treating the pigment in a ball mill. A mixture of 10 parts by weight (dry basis) of said aqueous dispersion, 25 parts by weight (dry basis) of an aqueous solution of polyvinyl alcohol, and 65 parts by weight (dry basis) of an emulsion of microcrystalline wax having a melting point of 84° C. was stirred thoroughly to form a uniform coating composition. The resulting aqueous coating composition was applied, by means of Mayer bar at a coverage of 6 g/m$^2$ on dry basis, onto the back side of PET film of 12 μm in thickness which had been subjected to heat-resisting treatment. The ink coated layer of the resulting donor sheet was brought into contact with a sheet of ordinary paper (a thermal transfer image receiving sheet "TTR-T", trade name, of Mitsubishi Paper Mills, Ltd.) to form a pair of recording material. A photograph with gradation was recorded by means of Panafax UF-1000 of Matsushita Denso Co. from the back side of the donor sheet and a sharp record with gradation was obtained.

In a similar manner, a record exhibiting gradation was obtained by using Permanent Carmine FB (C.I. 12490) as magenta pigment and Cromophtal Yellow 2G as yellow pigment.

EXAMPLE 9

A donor sheet was prepared by coating, by means of Mayor bar at a coverage of 4 g/m$^2$ on dry basis, a capacitor tissue of 10 μm in thickness, with an aqueous coating composition of a heat meltable ink comprising 2% by weight of Crystal Violet (CV), a water-soluble dye, 15% by weight of polyvinyl alcohol, a binder, and 83% by weight of microcrystalline wax, a wax having a melting point of 84° C.

An image receiving sheet was prepared by coating an ordinary paper (a thermal transfer image receiving paper TTR-T, trade name, of Mitsubishi Paper Mills, Ltd.) with an aqueous emulsion of methylol amide having a melting point of 107° C. and containing no adhesive, at a coverage of 5 g/m$^2$ on dry basis, by means of Mayor bar.

The ink coating layer of the donor sheet was brought into contact with the wax coating layer of the image receiving sheet. Thermal impression was performed by applying thermal printing to the back side of the donor sheet by means of a facsimile test apparatus (Matsushita Denshi Buhin Co.) while varying the 16.0 V pulse width from 1.0 to 3.0 milliseconds at 0.2 millisecond steps. The density of the transferred image was measured with an optical densitometer (Macbeth, Type RD 514).

For comparison, similar experiment was conducted by using an image receiving sheet with no wax coat and an image receiving sheet coated with a paraffin wax having a melting point of 67° C. which is lower than the melting point of heat meltable ink coated on the donor sheet.

The results were as shown in Table 8. As is apparent from the results, the combination of a donor sheet and an image receiving sheet according to this invention showed with the increase in pulse width an approximately linear increase of the image density starting from a small pulse width, indicating excellent gradation. On the contrary, the uncoated image receiving sheet showed with the increase in pulse width gradual increase of image density along a curve starting from a small pulse width. Similar tendency was shown by the sheet coated with a paraffin wax melting at 67° C. which is lower than the melting point of the heat meltable ink layer on the donor sheet, the gradation being inferior to that reproduced on the uncoated image receiving sheet.

TABLE 8

| Image receiving sheet | | Pulse width (millisecond) | | | | | | | | | | |
|---|---|---|---|---|---|---|---|---|---|---|---|---|
| Wax | Melting point (°C.) | 1.0 | 1.2 | 1.4 | 1.6 | 1.8 | 2.0 | 2.2 | 2.4 | 2.6 | 2.8 | 3.0 |
| Methylol amide | 107 | 0.13 | 0.21 | 0.30 | 0.38 | 0.45 | 0.52 | 0.58 | 0.64 | 0.66 | 0.68 | 0.68 |
| Paraffin wax | 67 | 0.28 | 0.42 | 0.55 | 0.63 | 0.68 | 0.69 | 0.70 | 0.70 | 0.70 | 0.70 | 0.70 |
| Uncoated base sheet | — | 0.15 | 0.33 | 0.50 | 0.57 | 0.60 | 0.63 | 0.67 | 0.68 | 0.69 | 0.70 | 0.70 |

EXAMPLE 10

Donor sheets were prepared by coating, by means of Mayer bar at a coverage of 4 g/m$^2$ on dry basis, a capacitor tissue of 10 μm in thickness with an aqueous coating composition of a heat meltable ink comprising a fixed amount of 2% by weight of a water-soluble dye, Crystal Violet (CV), 1, 5, 10, 55, or 0% by weight of an ethylene-vinyl acetate emulsion (OM-4000, trade name, of Kuraray Co.) as binder, and 97, 93, 88, 43, or 98% by weight, respectively, of a paraffin wax melting at 60° C., used as a wax.

An image receiving sheet was prepared by coating, by means of Mayer bar at a coverage of 5 g/m$^2$ on dry basis, a sheet of ordinary paper (thermal transfer image receiving paper TTR-T of Mitsubishi Paper Mills, Ltd.) with an aqueous emulsion of microcrystalline wax melting at 96° C., which contained no adhesive.

By using a combination of the above donor sheet and image receiving sheet, thermal impression and the measurement of image density were performed as in Example 9. The results were as shown in Table 9.

As is apparent from Table 9, the combination of a donor sheet and an image receiving sheet according to this invention, wherein the binder content was 1, 5, or 10% by weight, showed excellent reproduction of gradation as in Example 9, whereas when the binder content was 0%, with the increase in pulse width the image density showed gradual increase along a curve starting from a small pulse width, indicating insufficient gradation. When the binder content was 55% by weight, the thermal transfer was insufficient owing to a high adhesive strength of the binder, the image being low in density and gradation.

TABLE 9

| | | No. 1 | No. 2 | No. 3 | No. 4 | No. 5 |
|---|---|---|---|---|---|---|
| Compounding ratio | Crystal Violet | 2 | 2 | 2 | 2 | 2 |
| | Ethylene-vinyl acetate emulsion | 1 | 5 | 10 | 55 | 0 |
| | Paraffin wax | 97 | 93 | 88 | 43 | 98 |
| Pulse width (millisecond) | 1.0 | 0.16 | 0.09 | 0.05 | 0.04 | 0.49 |
| | 1.2 | 0.24 | 0.20 | 0.14 | 0.05 | 0.57 |
| | 1.4 | 0.32 | 0.27 | 0.21 | 0.06 | 0.60 |
| | 1.6 | 0.37 | 0.33 | 0.27 | 0.06 | 0.62 |
| | 1.8 | 0.43 | 0.38 | 0.33 | 0.07 | 0.63 |
| | 2.0 | 0.49 | 0.44 | 0.38 | 0.07 | 0.64 |
| | 2.2 | 0.54 | 0.50 | 0.44 | 0.08 | 0.65 |
| | 2.4 | 0.58 | 0.56 | 0.50 | 0.08 | 0.66 |
| | 2.6 | 0.62 | 0.59 | 0.56 | 0.09 | 0.66 |
| | 2.8 | 0.62 | 0.60 | 0.58 | 0.09 | 0.67 |
| | 3.0 | 0.63 | 0.60 | 0.59 | 0.09 | 0.67 |

EXAMPLE 11

In the present Example, Crystal Violet, a water-soluble dye used in Example 9, was replaced by a water-insoluble cyan pigment, Phthalocyanine Blue (C.I. 74160). An aqueous dispersion, about 1 μm in particle size, was prepared by treating the pigment in a ball mill. A mixture of 10 parts by weight (dry basis) of said aqueous dispersion of the cyan pigment, 25 parts by weight (dry basis) of an aqueous solution of polyvinyl alcohol, and 65 parts by weight (dry basis) of an emulsion of microcrystalline wax having a melting point of 84° C. was stirred sufficiently to form a uniform coating composition. The resulting aqueous coating composition was applied, by means of Mayer bar at a coverage of 6 g/m$^2$ on dry basis, onto the back side of PET film, 12 μm in thickness, which had been subjected to heat-resisting treatment, to obtain a donor sheet. The ink layer of the resulting donor sheet was brought into contact with the same image receiving sheet as used in Example 9 to form a recording material. Using this recording material, an original of a photograph with gradation was recorded by means of Panafax UF-1000 of Matsushita Denso Co. There was obtained a sharp record in which gradation of the original was reproduced.

In a similar manner, a record exhibiting the gradation of original was obtained by using Permanent Carmine FB (C.I. 12490) as magenta pigment and Cromophtal Yellow 2G as yellow pigment.

What is claimed is:

1. A thermal transfer recording material capable of developing gradation, which comprises a combination of a donor sheet having a heat meltable ink layer on a support and a thermal transfer image receiving sheet which are superposed so that the heat meltable ink layer on the donor sheet contacts with the image receiving sheet, the thermal transfer being carried out by a thermal head, wherein said image receiving sheet has, coated thereon, a heat meltable substance having a melting point higher than that of said heat meltable ink layer.

2. A thermal transfer recording material according to claim 1, wherein the heat meltable substance is a waxy substance having a melting point in the range of from 50° to 200°.

3. A method of thermal transfer recording, which comprises using the thermal transfer recording material according to claim 1 and transferring the molten ink under application of heat from a thermal head.

4. A thermal transfer recording material according to claim 1 wherein the ink of the ink layer is a colored ink.

5. A method of thermal transfer recording which comprises using the thermal transfer recording material according to claim 4 and transferring the molten ink under application of heat from a thermal head.

6. A thermal transfer recording material capable of developing gradation, which comprises a combination of a donor sheet having a heat meltable ink layer on a support and a thermal transfer image receiving sheet which are superposed so that the heat meltable ink layer on the donor sheet contacts with the image receiving sheet, the thermal transfer being carried out by a thermal head, wherein said heat meltable ink layer principally comprises a colored dye or pigment, a binder and a wax which are coated on the support as an aqueous solution and/or an aqueous emulsion and said image receiving sheet has, coated thereon, a heat meltable substance having a melting point higher than that of said heat meltable ink.

7. A thermal transfer recording material capable of developing gradation according to claim 6, wherein said heat meltable ink layer comprises 0.5 to 25% by weight of a colored dye or pigment, 0.5 to 50% by weight of a binder, and 50 to 99% by weight of a wax.

8. A thermal transfer recording material capable of developing gradation according to claim 6, wherein the colored dye or pigment consists of at least yellow, magenta, and cyan colors and the heat meltable inks containing these colors are each partially coated on the same support.

9. A thermal transfer recording material capable of developing gradation according to claim 6, wherein the heat meltable substance is a wax substance having a melting point in the range of from 50° to 200° C.

10. A method of thermal transfer recording, which comprises using the thermal recording material according to claim 6 and transferring the molten ink under application of heat from a thermal head.

* * * * *